United States Patent [19]

Lutz

[11] 4,060,194

[45] Nov. 29, 1977

[54] HEATING SYSTEM AND ELEMENT THEREFOR

[76] Inventor: George H. Lutz, 1210 Front St., Binghamton, N.Y. 13905

[21] Appl. No.: 664,922

[22] Filed: Mar. 8, 1976

[51] Int. Cl.[2] ..... F24C 9/00

[52] U.S. Cl. ..... 237/1 SL; 122/26; 126/247

[58] Field of Search ..... 237/1 R, 2 R, 1 SL; 122/26; 126/247; 138/44; 417/199 A

[56] References Cited

U.S. PATENT DOCUMENTS

| | | | |
|---|---|---|---|
| 2,764,147 | 9/1956 | Brunner | 122/26 X |
| 2,915,299 | 12/1959 | Woebcke | 122/26 X |
| 3,379,132 | 4/1968 | Wagner | 417/199 A X |
| 3,545,492 | 12/1970 | Scheid, Jr. | 138/44 X |
| 3,720,372 | 3/1973 | Jacobs | 122/26 X |
| 3,813,036 | 5/1974 | Lutz | 237/2 R |

*Primary Examiner*—William E. Wayner
*Assistant Examiner*—William E. Tapolcai, Jr.
*Attorney, Agent, or Firm*—Samuelson & Jacob

[57] ABSTRACT

A closed heating system in which a silicone fluid having a high specific heat is pumped through an element formed of tetrafluoroethylene. The element is provided with a plurality of small openings through which the fluid is forced. The fluid is heated and the heated fluid is forced to blow through one or more heat transfer units through which heat is transferred to the ambient atmosphere.

11 Claims, 2 Drawing Figures

HEATING SYSTEM AND ELEMENT THEREFOR

The invention relates to closed heating systems utilizing a silicone liquid having a high specific heat as the heat transfer medium. In particular, the invention relates to an improved heat generating unit for use in such systems.

Most present heating systems, residential, commercial and industrial, possess some or all of the following inherent disadvantages:

1. Inefficient heat transfer.
2. Discharge of pollutants into the atmosphere.
3. Wide temperature differential in the heat area during mild days.
4. High, uneconomical cost.

The system of the invention in addition to not having the foregoing disadvantages is also safer in operation.

Broadly, the invention comprises a closed heating system using a liquid such as Union Carbide Y-7007 silicone fluid as the heat transfer medium. The liquid is pumped through the system which comprises a heat generating unit, preferably in the form of a cylindrical block having a plurality of small longitudinal holes or openings, and one or more heat transfer means. The heat generating unit is formed of tetrafluoroethylene and has a melting point above 300° F. The small openings permit only a small amount of the liquid to pass through and the balance of the fluid, which does not pass through the openings initially, builds up a back compressional force which heats the fluid. As the heated fluid passes through the heat transfer means, heat is given off to the ambient environment.

It is an important object of the invention to provide such a heating system which is economical to operate, efficient and environmentally clean.

It is a further object of the invention to provide such a heating system which may be used for space heating.

It is another object of the invention to provide such a heating system which may be used for industrial processing and/or drying.

These and other objects, advantages, features and uses will be apparent during the course of the following description, when taken in conjunction with the accompanying drawings, wherein.

Figure 1:
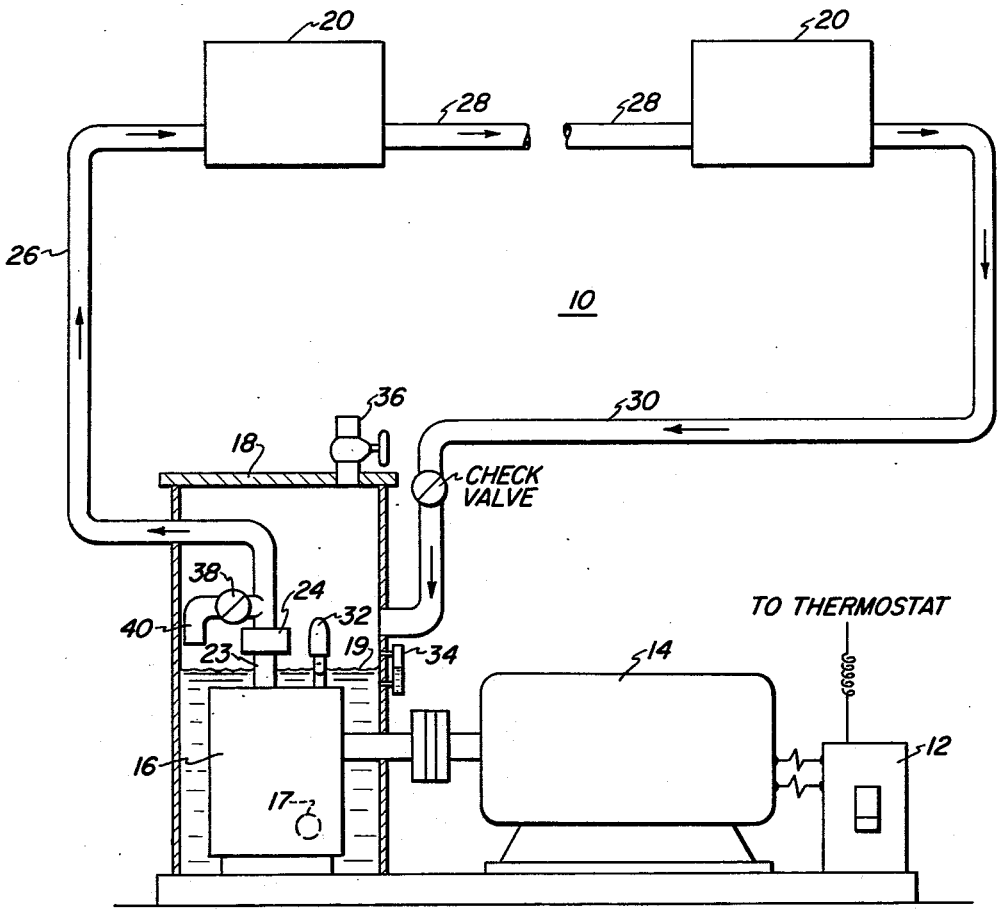
FIG. 1 is a block diagram of a heating system of the invention.
Figure 2:
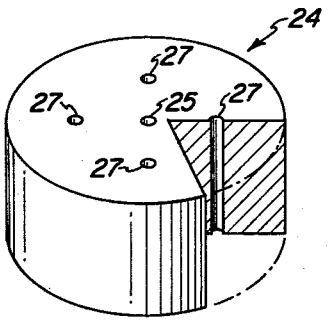
FIG. 2 is a perspective view, partly broken away, of a heat generating element used in the heating system of FIG. 1.

The heating system of the invention lends itself to many different applications. For example, it may be used for space heating (central or single room) in a manner similar to a hot water system as illustrated in the drawing. It adapts itself to a hot air heating system by using one or more heat transfer means mounted in the plenum of a hot air unit. It may also be used for industrial processing and/or drying by proper placement of the heat transfer means to obtain optimum benefit.

It has been found that the heating system of the invention will heat an average home during the heating season for less than that of the cost of an oil heating system. Similar savings are also obtained as compared with the costs of other heating systems.

In the drawing, wherein, for the purpose of illustration, there are shown preferred embodiments of the invention and wherein like numerals designate like parts throughout the same, the numeral 10 designates the heating system of the invention generally.

System 10 is a closed system and is seen to comprise a main switch 12 which controls a motor 14 which operates a pump 16. A thermostat (not shown) controls the operation of the system in a manner which is well known in the art. Liquid, preferably Union Carbide Y-7007 silicone fluid, having a specific heat of about 0.86 and a viscosity of the order of 100 centistokes, is contained in a storage tank 18. Pump 16 is submerged below the fluid level 19 in storage tank 18. A liquid distribution line 23 is connected between the outlet of pump 16 and a heat generating unit 24. A further such line 26 is connected between the heat generating unit 24 and a heat transfer means 20 which may be a hot water system radiator, for example.

An additional such line 28 is connected between subsequent heat transfer means 20 so that the heat transfer means are in series. A further such line 30 connects the last heat transfer means 20 to the return to pump 16 through the storage tank and inlet 17. The system is provided with a filling valve 36, a fluid level gauge 34 and a safety valve 32, all of which operate in a manner well known in the art. A three way flow valve 38 and line 40 are located within storage tank 18 and are provided to control the amount of fluid being fed to line 26 in order to maximize heat efficiency.

Operation proceeds as follows: the system is turned on by means of switch 12 and if the thermostat calls for heat, the motor 14 turns on and pump 16 starts to operate. The liquid is pumped toward heat generating unit 24 which is formed of a material having thermal integrity such as FLUOROSINT TFE. By "thermal integrity" is meant a material which will not melt or change its basic shape within the operating temperature range. The material in question has a melting point of about 620° F. Unit 24 is provided with a central longitudinal hole 25 and a plurality of such holes 27 equally spaced from each other and from central hole 25. It has been found that an excellent location is on the circle having one-half the radius of unit 24. Unit 24 is placed in the circuit so that the only flow of fluid is through the holes. It is press fit in a stainless steel shell and connected between lines 23 and 26 so that there is no fluid leakage.

The fluid is forced through the holes 25 and 27 but because they are relatively small, of the order of 0.032 inch in diameter, most of the fluid is compressed a small amount by the pump thereby building up a back compressional force and heating the fluid by means of the compressional shear forces, the so-called heat of compression. In a short time, the heated fluid is forced through the openings into liquid distribution line 26 and through heat transfer means 20, then through distribution lines 28 to the other heat transfer means 20 and back to pump 16 through line 30.

When the thermostat stops calling for heat, the motor turns off. As long as switch 12 is on, the system will operate on call of the thermostat.

By way of example and not by way of limitation of the scope of the invention, it has been found that a heating system of the invention will deliver in excess of 40,000 BTU per hour, enough to heat a 1,000 sq. ft. home if it has the following parameters:

5 HP motor-pump having a pressure range up to 900 psi about 45 lbs. of Union Carbide Y-7007 silicone fluid having a specific heat of 0.86 at 100° F FLUOROSTINT TFE heat generating unit 1 inch in diameter, ½ inch long and having a central hole 0.032 inch in diameter and four equally spaced holes of the same size on a circle of ½ inch in radius.

It should be understood that the fluid may be changed so long as one of high specific heat to ensure high heat transfer and of good thermal integrity is used.

The heat generating unit will expand as the temperature rises and the fluid viscosity lowers thereby maintaining a constant back pressure. The heat generating unit size is increased in systems of larger capacity so that the pressure remains at 900 psi.

It has been found that 12 pounds of a petroleum fluid having a specific heat of 0.40 will rise 30° F in 30 secs. with a 25 ampere input to the pump and deliver 17,280 BTUH. A similar quantity of silicone fluid having a specific heat of 0.86 will deliver 37,152 BTUH under the same conditions.

Similarly, other heat generating unit materials may be used and the size and number of the holes may be changed so long as the holes are small enough and the solid area on the face of the unit is large enough to generate a good back compressional force with the resulting high temperature rise. Needless to say, the heat generating unit must maintain its structural stability over the operating temperature range of the system.

While particular embodiments of the invention have been shown and described, it is apparent to those skilled in the art that modifications are possible without departing from the spirit of the invention or the scope of the subjoined claims.

The embodiments of the invention in which an exclusive property or privilege is claimed are defined as follows.

1. A closed heating system comprising:
a liquid storage tank;
a liquid in the liquid storage tank;
a pump connected to the liquid storage tank to pump liquid therefrom;
means for operating the pump;
at least one heat transfer means;
a heat generating unit;
a first liquid distribution line connected from the pump to the heat generating unit;
a second liquid distribution line connected from the heat generating unit to the heat transfer means;
a third liquid distribution line connected from the heat transfer means to the pump to thereby form a closed system;
the liquid being somewhat compressible and having a specific heat in the order of 0.86;
the heat generating unit being formed of a synthetic resin material having a melting point above 300° F and having a plurality of small holes therein through which the liquid is forced, the holes being of such size that a back compressional force is developed in the liquid not flowing through the openings thereby causing the temperature of the liquid to rise and deliver heat to the heat transfer means;
the thermal integrity of the heat generating unit being such that the back compressional force is maintained over the operating temperature range of the liquid.

2. The invention of claim 1 wherein:
the pump is submerged in the liquid in the liquid storage tank; and
the third liquid distribution line is connected to the pump through the liquid contained in the liquid storage tank.

3. The invention of claim 2 including:
a plurality of heat transfer means connected in series between the heat generating unit and the pump by means of liquid distribution lines to thereby maintain the closed system.

4. The invention of claim 3 wherein:
the liquid is a silicone fluid.

5. The invention of claim 4 wherein:
the heat generating unit is formed of tetrafluoroethylene.

6. The invention of claim 3 wherein:
the heat generating unit is formed of tetrafluoroethylene.

7. The invention of claim 1 wherein:
the heat generating unit is formed of tetrafluoroethylene.

8. The invention of claim 1 wherein:
the liquid is a silicone fluid.

9. In a closed heating system utilizing a liquid having a high specific heat as the heat transfer medium and having storage means for storing the liquid, pump means for pumping the liquid through the system, a heat generating unit to which the liquid is pumped to thereby heat the liquid, heat transfer means for transferring heat from the liquid to the ambient atmosphere, the heat generating unit comprising:
a block of synthetic resin material having a melting point above 300° F;
the block having a plurality of small longitudinal openings through which a small quantity of the liquid is forced to thereby develop a back compressional force in the liquid not flowing through the openings which causes the liquid temperature to rise;
the thermal integrity of the block being such that the back compressional force is maintained over the operating temperature range of the liquid.

10. The invention of claim 9 wherein:
the block is a cylinder; and
there is one central longitudinal opening and a plurality of equally spaced longitudinal openings midway between the outer edge and the axes of the cylinder.

11. The invention of claim 9 wherein:
the block is formed of tetrafluoroethylene.

* * * * *